US011851739B2

(12) United States Patent
Wang et al.

(10) Patent No.: US 11,851,739 B2
(45) Date of Patent: Dec. 26, 2023

(54) HIGH-STRENGTH MAGNESIUM ALLOY PROFILE, PREPARATION PROCESS THEREFOR AND USE THEREOF

(71) Applicant: CHONGQING UNIVERSITY, Chongqing (CN)

(72) Inventors: Jingfeng Wang, Chongqing (CN); Kui Wang, Chongqing (CN); Shijie Liu, Chongqing (CN); Xing Peng, Chongqing (CN); Fusheng Pan, Chongqing (CN)

(73) Assignee: Chongqing University, Chongqing (CN)

( * ) Notice: Subject to any disclaimer, the term of this patent is extended or adjusted under 35 U.S.C. 154(b) by 0 days.

(21) Appl. No.: 16/963,866

(22) PCT Filed: Jul. 1, 2019

(86) PCT No.: PCT/CN2019/094180
§ 371 (c)(1),
(2) Date: Jul. 22, 2020

(87) PCT Pub. No.: WO2020/082779
PCT Pub. Date: Apr. 30, 2020

(65) Prior Publication Data

US 2021/0238723 A1 Aug. 5, 2021

(30) Foreign Application Priority Data

Oct. 23, 2018 (CN) ..... 201811237928.6

(51) Int. Cl.
*C22F 1/06* (2006.01)
*C22C 23/06* (2006.01)

(52) U.S. Cl.
CPC ..... *C22F 1/06* (2013.01); *C22C 23/06* (2013.01)

(58) Field of Classification Search
CPC ..... C22F 1/06; C22C 23/06
See application file for complete search history.

(56) References Cited

U.S. PATENT DOCUMENTS

2009/0263271 A1 10/2009 Meng et al.
2013/0209195 A1* 8/2013 Kuwabara ..... C22F 1/06 411/378

FOREIGN PATENT DOCUMENTS

CN 101914737 B * 12/2011
CN 102732763 A 10/2012
(Continued)

OTHER PUBLICATIONS

Chen Z, CN-101914737-B machine translation, Dec. 14, 2011 (Year: 2011).*

(Continued)

*Primary Examiner* — Nicholas A Wang
*Assistant Examiner* — Maxwell Xavier Duffy
(74) *Attorney, Agent, or Firm* — Patrick M. Torre; Stites & Harbison PLLC

(57) ABSTRACT

Provided are a high-strength magnesium alloy profile, a preparation process therefor and the use thereof, wherein same relate to the technical field of the formation of high-strength magnesium alloys. A strengthening phase of the high-strength magnesium alloy profile in an extrusion state mainly comprises LPSO phase and β phase, wherein the volume fraction of LPSO phase is 1-40%; and the volume fraction of β phase is 1-20%. A strengthening phase of the high-strength magnesium alloy profile in an aging state mainly comprises LPSO phase, β phase, β' phase and γ' phase, wherein the volume fraction of LPSO phase is 1-40%; the volume fraction of β phase is 1-20%; the number density of β' phase is $10^{15}$-$10^{25}$ $m^{-3}$, and the length to thickness ratio l/d thereof is 1:20; and the number density of (Continued)

γ' phase is $10^{14}$-$10^{24}$ $m^{-3}$ and the length to thickness ratio l/d thereof is 1:50.

5 Claims, 1 Drawing Sheet

(56) References Cited

FOREIGN PATENT DOCUMENTS

| | | | |
|---|---|---|---|
| CN | 106148792 | A | 11/2016 |
| CN | 109182864 | A | 1/2019 |

OTHER PUBLICATIONS

S.N. Ab Rahim, M.A. Lajis, S. Ariffin, A Review of Recycling Aluminum Chips by Hot Extrusion Process, 2015, Elsevier, Procedia CIRP 26, pp. 761-766 (Year: 2015).*
English Translation of Foreign Office Action in CN 201811237928.6.
English Translation of International Search Report for PCT/CN2019/094180.
English Translation of CN109182864 (A).
English Translation of CN106148792 (A).
English Translation of CN102732763 (A).
Office Action for priority document of CN 201811237928.6—original.
English translation of Office Action for priority document of CN 201811237928.6.

* cited by examiner

HIGH-STRENGTH MAGNESIUM ALLOY PROFILE, PREPARATION PROCESS THEREFOR AND USE THEREOF

CROSS-REFERENCE TO RELATED APPLICATIONS

This application is the national stage of international patent application no. PCT/CN2019/094180 filed on Jul. 1, 2019 which in turn claims priority to Chinese Patent Application No. 201811237928.6, filed with the Chinese Patent Office on Oct. 23, 2018, entitled "High-strength Magnesium Alloy Profile, Preparation Process therefor and Use Thereof", which are incorporated herein by reference in their entirety.

TECHNICAL FIELD

The present disclosure relates to the technical field of molding of high-strength magnesium alloys, and in particular to a high-strength magnesium alloy profile, a process for preparing the same, and use thereof, mainly in the field of aircraft unit load devices.

BACKGROUND ART

Lightweighting is a global development trend and is of important strategic significance for alleviating the energy crisis and reducing pollution. Magnesium alloys, having the characteristics such as light specific gravity, high specific strength, shock absorption and noise reduction, and excellent electromagnetic shielding properties, are one type of the most promising lightweight materials. The magnesium alloys are widely used in the industrial fields of aviation, aerospace, national defense, automobiles, communications and electronics, computers, household appliances, and the like, and are known as "green environmentally-friendly engineering materials in the 21st century". However, the magnesium alloys are currently much less widely used than aluminum alloys. This is mainly because the magnesium alloys have disadvantages such as low absolute strength, poor deformability and processability at room temperature, proneness to oxidation and combustion, and proneness to corrosion, which limits their widespread use as structural materials.

Compared with traditional cast magnesium alloys, high-strength wrought magnesium alloys have excellent comprehensive properties, which have advantages such as high strength, good plasticity, and fatigue resistance, and thus are more suitable for critical parts that require high mechanical properties. Hence, the development of large-sized high-strength magnesium alloys and processing methods therefor is an important frontier subject in the field of research of magnesium alloys. On this basis, researchers have conducted a lot of research on alloying and heat treatment processes, and systems are formed for conventional high-strength magnesium alloys, rare-earth high-strength magnesium alloys, and the like. Traditional cast magnesium alloys have very coarse microstructures and poor mechanical properties. The magnesium alloys have low stacking fault energy and are likely to undergo dynamic recrystallization during deformation. In most cases, grains of magnesium alloys are refined by plastic deformation to improve their mechanical properties.

Although some progress has been made in the research of magnesium alloys, there are still some problems. As magnesium alloys show a hexagonal structure and poor plastic deformability, high-strength magnesium alloys have extremely high deformation resistance and can be deformed only in a narrow range of processing parameter. High-strength magnesium alloy profiles can hardly be extruded and molded directly, and mechanical properties thereof can hardly be guaranteed. At present, extruded high-strength magnesium alloy profiles are still in the laboratory development stage in the world, and these profiles are mostly bar profiles and sheet (or plate) profiles. The strength of magnesium alloy profiles actually produced in industry is generally not higher than 400 MPa, and the elongation of high-strength magnesium alloys usually does not exceed 5%. An advantageous technical system for plastic processing of wrought magnesium alloys has not been formed currently. There are still serious deficiencies in the development of products and use thereof. Wrought magnesium alloy products have not found applications in a huge market.

Therefore, it is desirable to obtain a high-strength magnesium alloy profile that can solve at least one of the problems described above.

SUMMARY

Objects of the present disclosure include, for example, providing a high-strength magnesium alloy profile, which has the advantages of high comprehensive mechanical properties at room temperature and good plasticity.

The objects of the present disclosure include, for example, providing a process for preparing the high-strength magnesium alloy profile described above, which has the same advantages as the high-strength magnesium alloy profile described above.

The objects of the present disclosure include, for example, providing use of the high-strength magnesium alloy profile described above or a high-strength magnesium alloy profile prepared by the process for preparing the high-strength magnesium alloy profile described above in the aviation and aerospace fields.

The objects of the present disclosure include, for example, providing a unit load device article comprising the high-strength magnesium alloy profile described above or a high-strength magnesium alloy profile prepared by the process for preparing the high-strength magnesium alloy profile described above.

The present disclosure provides a high-strength magnesium alloy profile, which is obtained mainly by a temperature-varying heat treatment, extruding and aging treatment of a magnesium alloy ingot;

wherein strengthening phase in the magnesium alloy in the extruded state includes an LPSO phase and a β phase; the LPSO phase is contained in a volume fraction of 1 to 40%, and the β phase is contained in a volume fraction of 1 to 20%;

strengthening phase in the magnesium alloy in the aged state includes an LPSO phase, a β phase, a β' phase, and a γ' phase; the LPSO phase is contained in a volume fraction of 1 to 40%, the β phase is contained in a volume fraction of 1 to 20%, the β' phase has a number density of $10^{15}$ to $10^{25}$ $m^{-3}$ and an aspect ratio l/d of 1 to 20, and the γ' phase has a number density of $10^{14}$ to $10^{24}$ $m^{-3}$ and an aspect ratio l/d of 1 to 50.

Here, the LPSO phase, i.e., long-period stacking ordered phase, is a long-period stacking ordered phase with a chemical formula of $Mg_{12}Zn(Gd, Y)$; the β phase is an equilibrium phase with a chemical formula of $Mg_5(Gd, Y)$; the β' phase is a metastable phase with a chemical formula of $Mg_7(Gd,$ Y); and the γ' phase is a stacking fault phase enriched with alloying elements, with a chemical formula of Mg(Gd, Y)Zn.

In one or more embodiments, in the magnesium alloy in the extruded state, the LPSO phase is contained in a volume fraction of 5 to 30%, and the β phase is contained in a volume fraction of 3 to 15%;

in one or more embodiments, in the magnesium alloy in the aged state, the LPSO phase is contained in a volume fraction of 5 to 30%, the β phase is contained in a volume fraction of 3 to 15%, the β' phase has a number density of $10^{20}$ to $10^{25}$ $m^{-3}$ and an aspect ratio l/d of 3 to 20, and the γ' phase has a number density of $10^{18}$ to $10^{24}$ $m^{-3}$ and an aspect ratio l/d of 10 to 50.

In one or more embodiments, when tensile mechanical properties are tested in the extruded state, tensile strength is 300 to 450 MPa, yield strength is 200 to 400 MPa, and elongation is 10 to 30%;

when the tensile mechanical properties are tested in the aged state, the tensile strength is 400 to 580 MPa, the tensile yield strength is 300 to 520 MPa, and the elongation is 5 to 20%.

In one or more embodiments, on the basis of the technical solution proposed in the present disclosure, the magnesium alloy ingot comprises the following components in mass percentage: 6 to 12% of Gd, 2.5 to 8.5% of Y, 0.2 to 2% of Zn, 0.2 to 2% of Mn, and Mg and inevitable impurities as the remainder; or 6 to 12% of Gd, 2.5 to 8.5% of Y, 0.2 to 2% of Zn, 0.2 to 2% of Zr, and Mg and inevitable impurities as the remainder.

In one or more embodiments, the magnesium alloy ingot comprises the following components in mass percentage: 6 to 12% of Gd, 2.5 to 8.5% of Y, 0.2 to 2% of Zn, 1.2 to 1.5% of Mn, and Mg and inevitable impurities as the remainder.

In one or more embodiments, the magnesium alloy ingot comprises the following components in mass percentage: 6 to 12% of Gd, 2.5 to 8.5% of Y, 0.2 to 2% of Zn, 1.5 to 2% of Zr, and Mg and inevitable impurities as the remainder.

In one or more embodiments, the magnesium alloy ingot comprises the following components in mass percentage: 9% of Gd, 5% of Y, 1.5% of Zn, 1.5% of Mn, and Mg and inevitable impurities as the remainder.

In one or more embodiments, the magnesium alloy ingot comprises the following components in mass percentage: 8% of Gd, 6% of Y, 1.2% of Zn, 1.2% of Mn, and Mg and inevitable impurities as the remainder.

In one or more embodiments, the magnesium alloy ingot comprises the following components in mass percentage: 6% of Gd, 8.5% of Y, 0.2% of Zn, 2% of Zr, and Mg and inevitable impurities as the remainder.

In one or more embodiments, the magnesium alloy ingot comprises the following components in mass percentage: 9% of Gd, 5% of Y, 1.5% of Zn, 1.5% of Mn, and Mg and inevitable impurities as the remainder.

In one or more embodiments, the high-strength magnesium alloy profile is in the form of a bar, a pipe, or a plate.

The present disclosure also provides a process for preparing the high-strength magnesium alloy profile described above, comprising the steps of:

Sequentially performing temperature-varying homogenizing, extruding, straightening, and aging treatments on a magnesium alloy ingot to obtain a high-strength magnesium alloy profile;

wherein the temperature-varying homogenizing treatment includes first performing a solid solution treatment at a temperature lower than a melting point of a second phase, and increasing the temperature into a melting temperature range of the second phase and maintaining the temperature of the solid solution after the second phase is fully solid-solved;

the aging treatment includes one mode of isothermal aging treatment, two-stage aging treatment, or temperature-varying aging treatment; the isothermal aging treatment is performed at a temperature ranging from 150 to 250° C.; the two-stage aging treatment is performed at a temperature ranging from 120 to 160° C. and at a temperature ranging from 160 to 250° C.; and the temperature-varying aging treatment is performed at a temperature ranging from 400 to 500° C. and at a temperature ranging from 150 to 250° C.

In one or more embodiments, the temperature-varying homogenizing treatment includes first maintaining the temperature at a temperature of 400 to 510° C. for 2 to 24 h, and then increasing the temperature to 510 to 560° C. and maintaining the temperature for 2 to 20 h;

in one or more embodiments, the temperature-varying homogenizing treatment includes first maintaining the temperature at a temperature of 410 to 500° C. for 2 to 24 h, and then increasing the temperature to 520 to 550° C. and maintaining the temperature for 3 to 15 h.

The present disclosure also provides use of the high-strength magnesium alloy profile described above or a high-strength magnesium alloy profile prepared by the process for preparing the high-strength magnesium alloy profile described above in the aviation and aerospace fields.

In one or more embodiments, the high-strength magnesium alloy profile is used in the manufacture of an aircraft unit load device.

In one or more embodiments, the aircraft unit load device is an aircraft container or an aircraft container plate.

The present disclosure also provides a unit load device article, comprising the high-strength magnesium alloy profile described above or a high-strength magnesium alloy profile prepared by the process for preparing the high-strength magnesium alloy profile described above;

in one or more embodiments, the unit load device article includes an aircraft unit load device, for example, including an aircraft container and an aircraft container plate.

The present disclosure includes at least the following advantageous effects:

(1) The present disclosure proposes a high-strength magnesium alloy profile, which has high comprehensive mechanical properties at room temperature and high plasticity, a tensile strength greater than 430 MPa, and an elongation greater than 8%. Compared with an aircraft unit load device formed from an aluminum alloy, this profile allows a single unit load device to have its weight reduced by more than 20%.

(2) The high-strength magnesium alloy profiles of the present disclosure are prepared by a simple process and can be produced in batches by ordinary extrusion production equipment, and the direct extrusion molding of high-strength magnesium alloy profiles is implemented with higher efficiency.

BRIEF DESCRIPTION OF DRAWINGS

In order to more clearly illustrate technical solutions of embodiments of the present disclosure, drawings required for use in the embodiments will be described briefly below. It should be understood that the drawings below are merely illustrative of some embodiments of the present disclosure, and therefore should not be considered as limiting its scope. It will be understood by those of ordinary skill in the art that other relevant drawings can also be obtained from these drawings without any inventive effort.

DETAILED DESCRIPTION OF EMBODIMENTS

Figure 1:
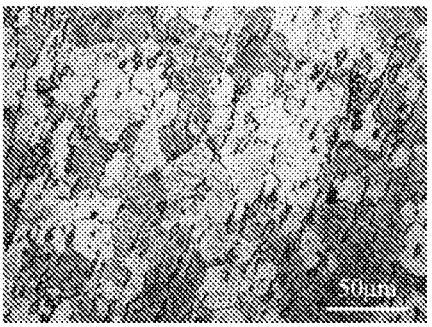
FIG. 1 shows a picture of a metallographic microstructure of a high-strength magnesium alloy profile according to the present disclosure.
Figure 2:
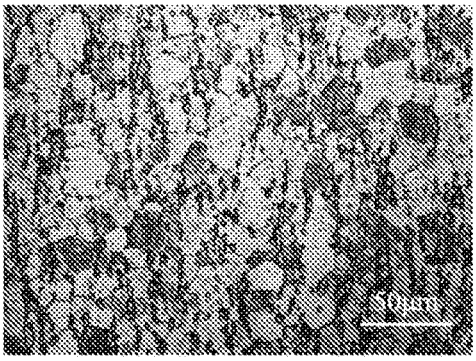
FIG. 2 shows a picture of a metallographic microstructure of another high-strength magnesium alloy profile according to the present disclosure.

The embodiments of the present disclosure will be described in detail below with reference to examples, but it will be understood by those skilled in the art that the following examples are only intended to illustrate the present disclosure and should not be considered as limiting the scope of the present disclosure. Examples are carried out in accordance with conventional conditions or conditions recommended by manufacturers, if no specific condition is specified in the examples. Reagents or instruments used, whose manufacturers are not specified, are all conventional products that are available commercially.

The present disclosure provides a high-strength magnesium alloy profile, which is obtained mainly by a temperature-varying heat treatment, extruding and aging treatment of a magnesium alloy ingot, wherein strengthening phase in the magnesium alloy in the extruded state mainly includes an LPSO phase and a β phase, the LPSO phase is contained in a volume fraction of 1 to 40%, and the β phase is contained in a volume fraction of 1 to 20%; strengthening phase in the magnesium alloy in the aged state mainly includes an LPSO phase, a β phase, a β' phase, and a γ' phase. The LPSO phase is contained in a volume fraction of 1 to 40%, the β phase is contained in a volume fraction of 1 to 20%, the β' phase has a number density of $10^{15}$ to $10^{25}$ $m^{-3}$ and an aspect ratio l/d of 1 to 20, and the γ' phase has a number density of $10^{14}$ to $10^{24}$ $m^{-3}$ and an aspect ratio l/d of 1 to 50.

The high-strength magnesium alloy profiles include, but are not limited to, bars, pipes, profiles, plates, and so on.

The high-strength magnesium alloy profiles are magnesium alloys having a tensile strength greater than 400 MPa. High-strength magnesium alloys have high deformation resistance and is difficult to be molded into profiles.

The main strengthening phase in the alloy in the extruded state includes an LPSO phase, a cylindrical β phase, and the like. The LPSO phase is contained in a volume fraction of 1 to 40%, including, but not limited to, 1%, 5%, 10%, 15%, 20%, 25%, 30%, 35%, or 40%, and the β phase is contained in a volume fraction of 1 to 20%, including, but not limited to, 1%, 2%, 5%, 10%, 15%, or 20%.

The alloy in the aged state has a β' phase and a γ' phase, in addition to the LPSO phase and the β phase. The β' phase has a number density of $10^{15}$ to $10^{25}$ $m^{-3}$, including, but not limited to, $10^{15}$ $m^{-3}$, $10^{16}$ $m^{-3}$, $10^{18}$ $m^{-3}$, $10^{20}$ $m^{-3}$, $10^{22}$ $m^{-3}$, or $10^{25}$ $m^{-3}$, and has an aspect ratio l/d of 1 to 20, including, but not limited to, 1, 2, 5, 8, 10, 12, 15, 18, 19, or 20; and the γ' phase has a number density of $10^{14}$ to $10^{24}$ $m^{-3}$, including, but not limited to, $10^{14}$ $m^{-3}$, $10^{15}$ $m^{-3}$, $10^{18}$ $m^{-3}$, $10^{20}$ $m^{-3}$, $10^{22}$ $m^{-3}$, or $10^{24}$ $m^{-3}$, and has an aspect ratio l/d of 1 to 50, including, but not limited to, 1, 2, 3, 4, 5, 6, 7, 8, 9, 10, 20, 30, 40, or 50.

The high-strength magnesium alloy profile of the present disclosure has a special microstructure structure and is imparted with excellent comprehensive mechanical properties at room temperature and excellent plasticity, a tensile strength greater than 430 MPa, and an elongation greater than 8%. Compared with an aircraft unit load device formed from an aluminum alloy, this profile allows a single unit load device to have its weight reduced by more than 20%.

In one or more embodiments, in the magnesium alloy in the extruded state, the LPSO phase is contained in a volume fraction of 5 to 30%, and the β phase is contained in a volume fraction of 3 to 15%.

In one or more embodiments, in the magnesium alloy in the aged state, the β' phase has a number density of $10^{20}$ to $10^{25}$ re and an aspect ratio l/d of 3 to 20, and the γ' phase has a number density of $10^{18}$ to $10^{24}$ $m^{-3}$ and an aspect ratio l/d of 10 to 50.

The microstructure characteristics of the alloy in the extruded state and in the aged state are optimized, so that the alloy has higher strength and plasticity.

The tensile mechanical properties of the magnesium alloy profiles with preferred microstructure characteristics, including ultimate tensile strength (UTS), tensile yield strength (TYS), and elongation (EL), are tested as specifically shown in Table 1.

TABLE 1

| Alloy State | UTS (MPa) | TYS (MPa) | EL (%) |
|---|---|---|---|
| Extruded State | 300-450 | 200-400 | 10-30 |
| Aged State | 400-580 | 300-520 | 5-20 |

In one or more embodiments, room-temperature tensile properties are tested on a Shimadzu CMT-5105 electronic universal tester.

In one or more embodiments, the magnesium alloy ingot comprises the following components in mass percentage: 6 to 12% of Gd, 2.5 to 8.5% of Y, 0.2 to 2% of Zn, 0.2 to 2% of Mn, and Mg and inevitable impurities as the remainder; or 6 to 12% of Gd, 2.5 to 8.5% of Y, 0.2 to 2% of Zn, 0.2 to 2% of Zr, and Mg and inevitable impurities as the remainder.

The composition of the magnesium alloy ingot is optimized to comprise 6 to 12 wt. % of Gd, 2.5 to 8.5 wt. % of Y, 0.2 to 2 wt. % of Zn, 0.2 to 2 wt. % of Mn, and Mg and inevitable impurities as the remainder; or to comprise 6 to 12 wt. % of Gd, 2.5 to 8.5 wt. % of Y, 0.2 to 2 wt. % of Zn, 0.2 to 2 wt. % of Zr, and Mg and inevitable impurities as the remainder.

The inevitable impurities mainly include Si, Fe, and so on, and the total amount of the impurities is, for example, less than 0.1 wt. %.

A typical, but non-limiting, mass percentage of the Gd (gadolinium) component is, for example, 6%, 7%, 8%, 9%, 10%, 11%, or 12%; a typical, but non-limiting, mass percentage of the Y (yttrium) component is, for example, 2.5%, 3%, 3.5%, 4%, 4.5%, 5%, 5.5%, 6%, 6.5%, 7%, 7.5%, 8%, or 8.5%; a typical, but non-limiting, mass percentage of the Zn (zinc) component is, for example, 0.2%, 0.3%, 0.4%, 0.5%, 0.6%, 0.7%, 0.8%, 0.9%, 1.0%, 1.2%, 1.4%, 1.5%, 1.6%, 1.8%, or 2.0%; and a typical, but non-limiting, mass percentage of the Mn (manganese) component is, for example, 0.2%, 0.3%, 0.4%, 0.5%, 0.6%, 0.7%, 0.8%, 0.9%, 1.0%, 1.2%, 1.4%, 1.5%, 1.6%, 1.8%, or 2.0%.

A typical, but non-limiting, mass percentage of the Gd (gadolinium) component is, for example, 6%, 7%, 8%, 9%, 10%, 11%, or 12%; a typical, but non-limiting, mass percentage of the Y (yttrium) component is, for example, 2.5%, 3%, 3.5%, 4%, 4.5%, 5%, 5.5%, 6%, 6.5%, 7%, 7.5%, 8%, or 8.5%; a typical, but non-limiting, mass percentage of the Zn (zinc) component is, for example, 0.2%, 0.3%, 0.4%, 0.5%, 0.6%, 0.7%, 0.8%, 0.9%, 1.0%, 1.2%, 1.4%, 1.5%, 1.6%, 1.8%, or 2.0%; and a typical, but non-limiting, mass percentage of the Zr (zirconium) component is, for example, 0.2%, 0.3%, 0.4%, 0.5%, 0.6%, 0.7%, 0.8%, 0.9%, 1.0%, 1.2%, 1.4%, 1.5%, 1.6%, 1.8%, or 2.0%.

The term "comprising" means that it may include other components in addition to the components described, and the term "comprising" may also be replaced with a closed term "is/are" or "consisting of".

It should be noted that the phrase "Mg and inevitable impurities as the remainder" means that the composition of the magnesium alloy ingot of the present disclosure comprises Mg as the remainder, other than Gd, Y, Zn, Mn and other elements and impurities, or other than Gd, Y, Zn, Zr and other elements and impurities. A sum of the amounts, by mass percentage, of Mg, Gd, Y, Zn, and Mn or Mg, Gd, Y, Zn, and Zr, and other elements and impurity components is 100%.

Zn, and Gd and Y can form LPSO phases in the magnesium alloy. These LPSO phases, as new hard phases in the magnesium matrix, can achieve significant strengthening and toughening effects.

In one or more embodiments, the magnesium alloy ingots are made by a semi-continuous casting process.

The present disclosure provides a process for preparing the high-strength magnesium alloy profile described above, comprising the steps of:

sequentially performing a temperature-varying homogenizing treatment, extruding, straightening and aging treatment on a magnesium alloy ingot(s) to obtain a high-strength magnesium alloy profile, wherein the temperature-varying homogenizing treatment includes first performing a solid solution treatment at a temperature lower than a melting point of a second phase, and increasing the temperature into a melting temperature range of the second phase and maintaining the temperature of the solid solution after the second phase is fully solid-solved; the aging treatment includes one mode of isothermal aging treatment, two-stage aging treatment, or temperature-varying aging treatment; the isothermal aging treatment is performed at a temperature ranging from 150 to 250° C.; the two-stage aging treatment is performed at a temperature ranging from 120 to 160° C. and at a temperature ranging from 160 to 250° C.; and the temperature-varying aging treatment is performed at a temperature ranging from 400 to 500° C. and at a temperature ranging from 150 to 250° C.

Temperature-Varying Homogenizing Treatment

The melting point of the second phase is, for example, at a temperature of 510 to 560° C. (1) The solid solution treatment is performed at a temperature slightly lower than the melting point of the second phase and the temperature is maintained for a long time, and (2) then the temperature is increased into the melting temperature range of the second phase and the temperature of the solid solution is maintained after the second phase is fully solid-solved.

Specifically, the steps (1) and (2) include: first performing a solid solution treatment at a temperature of 400 to 510° C., maintaining the temperature for 2 to 24 h and then increasing the temperature to 510 to 560° C. and maintaining the temperature for 2 to 20 h.

Extrusion refers to extruding an extruded profile from a magnesium alloy ingot using an extrusion device under the action of a die (or mold). The extrusion may be performed in a conventional manner using a magnesium alloy.

After extruded, the magnesium alloy is finished and straightened, the straightening including pressure straightening (straightening under pressure), warm straightening (stretch straightening is performed at a moderate or high temperature), and twisting straightening (twist straightening).

Aging Treatment

The aging treatment mode includes, for example, isothermal aging treatment, two-stage aging treatment, or temperature-varying aging treatment. In the case of the isothermal aging treatment, the temperature is in a range of 150 to 250° C.; in the case of the two-stage aging treatment (i.e., first at a low temperature and then at a high temperature), the temperatures are sequentially in the ranges of 120 to 160° C. and 160 to 250° C.; in the case of the temperature-varying aging treatment (i.e., first at a high temperature and then at a low temperature), the temperatures are sequentially in the ranges of 400 to 500° C. and 150 to 250° C.

The process for preparing the high-strength magnesium alloy profile has the same advantages as the high-strength magnesium alloy profile described above.

In one or more embodiments, a typical temperature-varying homogenizing treatment includes: increasing the temperature from room temperature to 200 to 300° C. and maintaining the temperature for 2 to 4 h; further increasing the temperature to 410 to 480° C. and maintaining the temperature for 6 to 15 h; further increasing the temperature to 520 to 530° C. and then maintaining the temperature for 8 to 10 h; cooling to 400 to 480° C. along with the furnace, and then rapidly cooling down at a cooling rate of 3 to 40° C./s.

The temperature-varying homogenizing treatment comprises four stages. In the first homogenizing treatment stage, the temperature is increased from room temperature to 200 to 300° C. and is maintained for 2 to 4 h, wherein the room temperature refers to an ambient temperature under non-heating condition, and the temperature is increased to a temperature including, but not limited to, 200° C., 250° C., or 300° C.; and the temperature is maintained for a period of time including, but not limited to, 2 h, 3 h, or 4 h; and the temperature is increased from room temperature to 200 to 300° C., for example, within 30 min, in order to control the heating rate. In the second homogenizing treatment stage, the temperature is increased to 410 to 480° C. and is maintained for 6 to 15 h, wherein the temperature is increased to a temperature including, but not limited to, 410° C., 420° C., 430° C., 440° C., 450° C., 460° C., 470° C., or 480° C.; the temperature is maintained for a period of time including, but not limited to, 6 h, 7 h, 8 h, 9 h, 10 h, 11 h, 12 h, 13 h, 14 h, or 15 h; and the temperature is increased to 410 to 480° C., for example, within 40 min, in order to control the heating rate, and the temperature is maintained for 6 to 15 h. In the third homogenizing treatment stage, the temperature is increased to 520 to 530° C. and is maintained for 8 to 10 h, wherein the temperature is increased to a temperature including, but not limited to, 520° C., 525° C., or 530° C.; the temperature is maintained for a period of time including, but is not limited to, 8 h, 9 h, or 10 h; and the temperature is increased to 520 to 530° C., for example, within 30 min, in order to control the heating rate, and then the temperature is maintained for 8 to 10 h. In the fourth homogenizing treatment stage, the temperature is decreased to 400 to 480° C., wherein the temperature is decreased to a temperature including, but not limited to, 400° C., 420° C., 440° C., 460° C., or 480° C.; and then rapid cooling is performed at a cooling rate of 3 to 40° C./s, for example, 3° C./s, 5° C./s, 10° C./s, 20° C./s, 30° C./s, or 40° C./s. By controlling the process parameters in the temperature-varying homogenizing treatment, a good homogenization effect is achieved, the microhardness of the alloy is improved, and uniform and consistent mechanical properties of the respective parts thereof are ensured, so that the latticed and granular precipitated phases in the as-cast microstructure of an as-cast Mg—Gd—Y—Zn—Mn or Mg—Gd—Y—Zn—Zr alloy disappear completely, and the phenomenon of component segregation in the cast alloy can be eliminated to the greatest extent, such that the elements of the alloy are uniformly distributed in the ingot.

In one or more embodiments, the extrusion comprises the steps of:

(1) preheating a pure magnesium ingot, a magnesium alloy ingot, an extrusion vessel of an extrusion device, and an extrusion die;

(2) feeding the preheated extrusion die into the extrusion device, first extruding the pure magnesium ingot which is extruded as a dummy ingot, and then extruding the magnesium alloy ingot.

In one or more embodiments, in the step (1), the pure magnesium ingot, the magnesium alloy ingot, the extrusion die, and the extrusion container are preheated to a temperature of 380 to 480° C., for example, 380° C., 390° C., 400° C., 410° C., 420° C., 430° C., 440° C., 450° C., 460° C., 470° C., or 480° C.

In one or more embodiments, in the step (2), the extrusion is performed at an extrusion speed of 10 to 200 mm/s and at an extrusion ratio of 8 to 30.

In one or more embodiments, the extrusion is performed at an extrusion rate of 20 to 60 mm/s and at an extrusion ratio of 10 to 30.

The extrusion ratio refers to a ratio of the cross-sectional area of the cavity of the extrusion container to the total cross-sectional area of the extruded article, also called an extrusion coefficient. The extrusion ratio is a parameter for indicating the magnitude of deformation of a metal in extrusion production, which is expressed by $\lambda$, wherein $\lambda=F_t/\Sigma F_1$, where $F_t$ is the cross-sectional area of the ingot blank which is filled in the extrusion container, in unit of $mm^2$; $\Sigma F_1$ is the total cross-sectional area of the extruded article, in unit of $mm^2$; and the magnitude of the deformation of the metal during extrusion may also be expressed by the degree of deformation $\varepsilon$, wherein $\varepsilon=\lambda-1$.

Each of the extrusion speed and the extrusion ratio is one of the main factors affecting the extrusion procedure of magnesium alloys. The occurrence of local cracks can be prevented and an extrudate can be obtained with the best quality by controlling a certain extrusion speed and extrusion ratio.

In one or more embodiments, a tractor is used for gripping and pulling the extruded profile during the extrusion, so as to ensure that the extruded profile is not excessively distorted.

In one or more embodiments, a typical aging treatment includes: maintaining the temperature at 400 to 480° C. for 5 to 30 h, and then cooling to room temperature, and then maintaining the temperature at 185 to 235° C. for 40 to 200 h.

In one or more embodiments, the cooling is water cooling. In the first stage of the aging treatment, the treatment is performed typically, but non-limitingly, at a temperature of for example, 400° C., 410° C., 420° C., 430° C., 440° C., 450° C., 460° C., 470° C., or 480° C., and the temperature is maintained typically, but non-limitingly, for a period of, for example, 5 h, 10 h, 15 h, 20 h, 25 h, or 30 h. In the second stage of the aging treatment, the treatment is performed typically, but non-limitingly, at a temperature of 185° C., 190° C., 195° C., 200° C., 205° C., 210° C., 215° C., 220° C., 225° C., 230° C., or 235° C., and the temperature is maintained typically, but non-limitingly, for a period of 40 h, 50 h, 60 h, 70 h, 80 h, 90 h, 100 h, 110 h, 120 h, 130 h, 140 h, 150 h, 160 h, 170 h, 180 h, 190 h, or 200 h. A magnesium alloy extrudate with excellent comprehensive properties including strength and tensile properties is finally obtained by controlling process parameters in the two stages of aging.

In one or more embodiments, a typical process for extrusion molding of a magnesium alloy comprises the steps of:

(1) performing a temperature-varying homogenizing treatment on a magnesium alloy ingot(s), including: feeding materials into a furnace, increasing a temperature from room temperature to 200 to 300° C. within 30 min and maintaining the temperature for 2 to 4 h; further increasing the temperature to 410 to 480° C. within 40 min and maintaining the temperature for 6 to 15 h; further increasing the temperature to 520 to 530° C. within 30 min and then maintaining the temperature for 8 to 10 h; subsequently turning off (or shutting down) the furnace and decreasing the temperature to 300 to 460° C. along with the furnace and maintaining the temperature for 4 to 8 h, and taking out the product;

wherein the magnesium alloy ingot comprises the following components in mass percentage: 6 to 12% of Gd, 2.5 to 8.5% of Y, 0.2 to 2% of Zn, 0.2 to 2% of Mn, and Mg and inevitable impurities as the remainder;

(2) preheating a pure magnesium ingot, the magnesium alloy ingot, an extrusion vessel of an extrusion device, and an extrusion die, wherein the pure magnesium ingot, the magnesium alloy ingot, and the extrusion die are preheated to a temperature of 440 to 480° C., and the extrusion vessel of the extrusion device is pretreated to a temperature of 435 to 475° C.;

(3) feeding the preheated extrusion die into the extrusion device, first extruding the pure magnesium ingot which is extruded as a dummy ingot, and then extruding the magnesium alloy ingot, wherein the extrusion is performed at an extrusion rate of 10 to 80 mm/s and at an extrusion ratio of 8 to 30;

(4) straightening the extruded and molded magnesium alloy profile, the straightening including pressure straightening, warm straightening, and twisting straightening, wherein the pressure straightening and the twisting straightening are performed at room temperature; and the warm straightening is performed at a temperature of 300 to 400° C.; and (5) performing an aging treatment on the extruded profile which has been straightened, the aging treatment including: maintaining the temperature at 400 to 480° C. for 5 to 30 h, then cooling to room temperature, and then maintaining the temperature at 185 to 235° C. for 40 to 100 h, whereby a high-strength magnesium alloy profile is obtained.

The magnesium alloy profiles obtained by this typical process for extrusion molding of a magnesium alloy have high dimensional accuracy and excellent comprehensive mechanical properties, and the alloy can have a tensile strength of 460 MPa or more, has good plasticity, and an elongation of up to 10%.

The present disclosure provides use of the high-strength magnesium alloy profile described above or a high-strength magnesium alloy profile prepared by the process for preparing the high-strength magnesium alloy profile described above in the aviation and aerospace fields.

The high-strength magnesium alloy profiles of the present disclosure have high comprehensive mechanical properties at room temperature, and are thus applicable to the aviation and aerospace fields, and have the prospect of widespread applications especially in the fabrication of aircraft containers (unit load devices).

Compared with an aircraft unit load device formed from an aluminum alloy, the magnesium-alloy aircraft unit load device made of this profile can have its weight reduced by more than 20%, as a single unit load device.

The present disclosure provides a unit load device article, comprising the high-strength magnesium alloy profile described above or a high-strength magnesium alloy profile prepared by the method for preparing the high-strength magnesium alloy profile described above.

In one or more embodiments, an aircraft unit load article, that is, an aircraft unit load device, includes, but is not limited to, an aircraft container, an aircraft container plate, and the like.

The aircraft unit load article has the same advantages as the high-strength magnesium alloy profile described above.

In order to provide a further understanding of the present disclosure, the methods and effects of the present disclosure will be further described in detail below with reference to specific examples and comparative examples. The following examples are only intended to illustrate the present disclosure and should not be considered as limiting the scope of the present disclosure. Examples are carried out in accordance with conventional conditions or conditions recommended by the manufacturer, if no specific conditions are specified in the examples. Reagents or instruments used, whose manufacturers are not specified, are all conventional products that are available commercially.

Example 1

The produced product was an I-beam profile formed from a magnesium alloy.

A process for extrusion molding of a magnesium alloy comprised the steps of:

(1) performing a temperature-varying homogenizing treatment of a magnesium alloy ingot, including: feeding materials into a furnace, increasing a temperature from room temperature to 200° C. within 30 min and maintaining the temperature for 4 h; further increasing the temperature to 410° C. within 40 min and maintaining the temperature for 15 h; further increasing the temperature to 520° C. within 30 min and then maintaining the temperature for 10 h; subsequently turning off the furnace, decreasing the temperature to 400° C. along with the furnace, rapidly cooling down at a rate of 3° C./s, and taking out the product, wherein the magnesium alloy ingot comprised the following components in mass percentage: 9% of Gd, 5% of Y, 1.5% of Zn, 1.5% of Mn, and Mg and inevitable impurities as the remainder;

(2) preheating a pure magnesium ingot, the magnesium alloy ingot, an extrusion container, and an extrusion die, wherein the pure magnesium ingot, the magnesium alloy ingot, and the extrusion die were preheated to a temperature of 450° C., and the extrusion container was pretreated to a temperature of 450° C.;

(3) feeding the preheated extrusion die into the extrusion device, first extruding the pure magnesium ingot which was extruded as a dummy ingot, and then extruding the magnesium alloy ingot, wherein the extrusion was performed at an extrusion rate of 60 mm/s and at an extrusion ratio of 12;

(4) straightening the extruded and molded magnesium alloy profile, the straightening including pressure straightening, warm straightening, and twisting straightening, wherein the pressure straightening and the twisting straightening were performed at room temperature; and the warm straightening was performed at a temperature of 350° C.;

(5) performing an aging treatment of the extruded profile which had been straightened, the aging treatment including: maintaining the temperature at 425° C. for 10 h, then cooling by water to room temperature, and then maintaining the temperature at 200° C. for 40 h, whereby a magnesium alloy profile was obtained.

Example 2

The produced product was an irregular profile formed from a magnesium alloy.

A process for extrusion molding of a magnesium alloy comprised the steps of:

(1) performing a temperature-varying homogenizing treatment of a magnesium alloy ingot, including: feeding materials into a furnace, increasing a temperature from room temperature to 300° C. within 30 min and maintaining the temperature for 2 h; further increasing the temperature to 480° C. within 40 min and maintaining the temperature for 6 h; further increasing the temperature to 530° C. within 30 min and then maintaining the temperature for 8 h; subsequently turning off the furnace, decreasing the temperature to 460° C. along with the furnace, rapidly cooling down at a rate of 40° C./s, and taking out the product, wherein the magnesium alloy ingot comprised the following components in mass percentage: 8% of Gd, 6% of Y, 1.2% of Zn, 1.2% of Mn, and Mg and inevitable impurities as the remainder;

(2) preheating a pure magnesium ingot, the magnesium alloy ingot, an extrusion container, and an extrusion die, wherein the pure magnesium ingot, the magnesium alloy ingot, and the extrusion die were preheated to a temperature of 460° C., and the extrusion container was pretreated to a temperature of 460° C.;

(3) feeding the preheated extrusion die into the extrusion device, first extruding the pure magnesium ingot which was extruded as a dummy ingot, and then extruding the magnesium alloy ingot, wherein the extrusion was performed at an extrusion rate of 50 mm/s and at an extrusion ratio of 10;

(4) straightening the extruded and molded magnesium alloy profile, the straightening including pressure straightening, warm straightening, and twisting straightening, wherein the pressure straightening and the twisting straightening were performed at room temperature; and the warm straightening was performed at a temperature of 380° C.; and (5) performing an aging treatment of the extruded profile which had been straightened, the aging treatment including: maintaining the temperature at 450° C. for 10 h, then cooling by water to room temperature, and then maintaining the temperature at 200° C. for 40 h, whereby a magnesium alloy profile was obtained.

Example 3

The produced product was an L-shaped profile formed from a magnesium alloy.

A process for extrusion molding of a magnesium alloy comprised the steps of:

(1) performing a temperature-varying homogenizing treatment of a magnesium alloy ingot, including: feeding materials into a furnace, increasing a temperature from room temperature to 250° C. within 30 min and maintaining the temperature for 3 h; further increasing the temperature to 450° C. within 40 min and maintaining the temperature for 10 h; further increasing the temperature to 525° C. within 30 min and then maintaining the temperature for 9 h; subsequently turning off the furnace, decreasing the temperature to 480° C. along with the furnace, rapidly cooling down at a rate of 10° C./s, and taking out the product, wherein the magnesium alloy ingot comprised the following components in mass percentage: 6% of Gd, 8.5% of Y, 0.2% of Zn, 2% of Zr, and Mg and inevitable impurities as the remainder;

(2) preheating a pure magnesium ingot, the magnesium alloy ingot, an extrusion container, and an extrusion die, wherein the pure magnesium ingot, the magnesium alloy ingot, and the extrusion die were preheated to a temperature of 440° C., and the extrusion container was pretreated to a temperature of 435° C.;

(3) feeding the preheated extrusion die into the extrusion device, first extruding the pure magnesium ingot which was extruded as a dummy ingot, and then extruding the magnesium alloy ingot, wherein the extrusion was performed at an extrusion rate of 10 mm/s and at an extrusion ratio of 8;

(4) straightening the extruded and molded magnesium alloy profile, the straightening including pressure straightening, warm straightening, and twisting straightening, wherein the pressure straightening and the twisting straightening were performed at room temperature; and the warm straightening was performed at a temperature of 300° C.;

(5) performing an aging treatment of the extruded profile which had been straightened, the aging treatment including: maintaining the temperature at 480° C. for 5 h, then cooling down to room temperature, and then maintaining the temperature at 185° C. for 100 h, whereby a magnesium alloy profile was obtained.

Example 4

The produced product was a T-shaped profile formed from a magnesium alloy.

A process for extrusion molding of a magnesium alloy comprised the steps of:

(1) performing a temperature-varying homogenizing treatment of a magnesium alloy ingot, including: feeding materials into a furnace, increasing a temperature from room temperature to 240° C. within 30 min and maintaining the temperature for 3.5 h; further increasing the temperature to 460° C. within 40 min and maintaining the temperature for 12 h; further increasing the temperature to 528° C. within 30 min and then maintaining the temperature for 8.5 h; subsequently turning off the furnace, decreasing the temperature to 400° C. along with the furnace, rapidly cooling down at a rate of 20° C./s, and taking out the product, wherein the magnesium alloy ingot comprised the following components in mass percentage: 12% of Gd, 2.5% of Y, 2% of Zn, 0.2% of Mn, and Mg and inevitable impurities as the remainder;

(2) preheating a pure magnesium ingot, the magnesium alloy ingot, an extrusion container, and an extrusion die, wherein the pure magnesium ingot, the magnesium alloy ingot, and the extrusion die were preheated to a temperature of 480° C., and the extrusion container was pretreated to a temperature of 475° C.;

(3) feeding the preheated extrusion die into the extrusion device, first extruding the pure magnesium ingot which was extruded as a dummy ingot, and then extruding the magnesium alloy ingot, wherein the extrusion was performed at an extrusion rate of 40 mm/s and at an extrusion ratio of 30;

(4) straightening the extruded and molded magnesium alloy profile, the straightening including pressure straightening, warm straightening, and twisting straightening, wherein the pressure straightening and the twisting straightening were performed at room temperature; and the warm straightening was performed at a temperature of 400° C.;

(5) performing an aging treatment of the extruded profile which had been straightened, the aging treatment including: maintaining the temperature at 400° C. for 30 h, then cooling down to room temperature, and then maintaining the temperature at 235° C. for 50 h, whereby a magnesium alloy profile was obtained.

Example 5

A process for extrusion molding of a magnesium alloy was carried out, wherein the pure magnesium ingot, the magnesium alloy ingot, and the extrusion die were preheated to a temperature of 400° C. and the extrusion container was preheated to a temperature of 410° C. in the step (2), and the other process conditions were the same as those in Example 1.

Example 6

A process for extrusion molding of a magnesium alloy was carried out, wherein the step (3) was performed at an extrusion rate of 30 mm/s and at an extrusion ratio of 11, and the other process conditions were the same as those in Example 1.

Comparative Example 1

A process for extrusion molding of a magnesium alloy was carried out, wherein the magnesium alloy ingot used in the step (1) comprised the following components in mass percentage: 9% of Gd, 5% of Y, 1% of Zn, and Mg and inevitable impurities as the remainder, and the other process conditions were the same as those in Example 1.

Comparative Example 2

A process for extrusion molding of a magnesium alloy was carried out, wherein the magnesium alloy ingot used in the step (1) comprised the following components in mass percentage: 5% of Gd, 10% of Y, 1% of Zn, 1% of Mn, and Mg and inevitable impurities as the remainder, and the other process conditions were the same as those in Example 1.

Comparative Example 3

A process for extrusion molding of a magnesium alloy was carried out, wherein the temperature-varying homogenizing treatment in the step (1) included: feeding materials into a furnace, increasing the temperature from room temperature to 320° C. and maintaining the temperature for 4 h; further increasing the temperature to 380° C. and maintain the temperature for 2 h; further increasing the temperature to 420° C. and then maintaining the temperature for 8 h; and taking out the workpiece which was then air-cooled, and the other process conditions were the same as those in Example 1.

Comparative Example 4

A process for extrusion molding of a magnesium alloy was carried out, wherein the aging treatment in the step (5) included: performing a first-stage aging treatment at 280° C. for 15 hours, and then performing a second-stage aging treatment at 220° C. for 10 hours, and the other process conditions were the same as those in Example 1.

Samples were taken from the finished products obtained in the above Examples and Comparative Examples for testing of strength and plasticity. The ultimate tensile strength (UTS), tensile yield strength (TYS), and elongation (EL) of the profiles were tested, and room-temperature tensile properties were tested on a Shimadzu CMT-5105 electronic universal tester. The test results can be seen in Table 2.

TABLE 2

Results of Testing of Strength and Plasticity of Samples from the Examples and Comparative Examples

| | Property Index | | | |
|---|---|---|---|---|
| Example | Alloy State | UTS (MPa) | TYS (MPa) | EL (%) |
| Example 1 | Extruded State | 344 | 212 | 27.1 |
| | Aged State | 468 | 260 | 11 |
| Example 2 | Extruded State | 355 | 245 | 19.6 |
| | Aged State | 471 | 271 | 10.1 |
| Example 3 | Extruded State | 382 | 284 | 18.3 |
| | Aged State | 493 | 346 | 9 |
| Example 4 | Extruded State | 405 | 322 | 16.2 |
| | Aged State | 538 | 472 | 7.2 |
| Example 5 | Extruded State | 425 | 398 | 14.2 |
| | Aged State | 546 | 481 | 6.3 |
| Example 6 | Extruded State | 448 | 432 | 11.2 |
| | Aged State | 572 | 498 | 5.5 |
| Comparative | Extruded State | 308 | 187 | 16 |
| Example 1 | Aged State | 435 | 218 | 5 |
| Comparative | Extruded State | 324 | 203 | 28.1 |
| Example 2 | Aged State | 423 | 248 | 15 |
| Comparative | Extruded State | 313 | 197 | 17 |
| Example 3 | Aged State | 352 | 236 | 6 |
| Comparative | Extruded State | 344 | 212 | 27.1 |
| Example 4 | Aged State | 382 | 221 | 5 |

As can be seen from Table 2, the magnesium alloy profiles of the Examples have high dimensional accuracy and excellent comprehensive mechanical properties, and may have an ultimate tensile strength of 460 MPa or more and a tensile yield strength of 260 MPa or more, and have good plasticity and an elongation of up to 10%.

Comparing Comparative Example 1 with Example 1, the composition of the alloy ingot used in Comparative Example 1 is composed of Mg—Gd(9%)-Y(5%)-Zn(1%), and the other process conditions are the same. As a result, it is found that the profile obtained in the comparative example has lower comprehensive mechanical properties than those of Examples 1, 2, 3, 4, 5, and 6. This is because the addition of the Mn or Zr element to the alloys of the Examples has a good purification effect, and additionally, the addition of the Mn element can facilitate the formation of a long-period phase.

Comparing Comparative Example 2 with Example 1, the composition of the alloy ingot used in Comparative Example 2 is composed of Mg—Gd(5%)-Y(10%)-Zn(1%)-Mn(1%), and the other process conditions are the same. As a result, it is found that the extrudate obtained in Comparative Example 2 has lower strength and slightly higher plasticity than those of Examples 1, 2, 3, 4, 5, and 6. This is because under the condition of the same total content of the long-period phases, a higher amount of the Y element and a lower amount of the Gd element facilitate the precipitation of blocky long-period phases at the grain boundaries, and accordingly lamellar long-period phases are reduced. The blocky long-period phases are helpful to the plasticity of the alloy, and the lamellar long-period phases are more helpful in increasing the strength.

The parameters in the temperature-varying homogenizing treatment used in Comparative Example 3 are different from those in Example 1, and the obtained magnesium alloy profile exhibits a great reduction in tensile strength and yield strength. This is because the alloy elements fail to completely form a solid solution, so that it is difficult to achieve a good microstructure state and aging hardening effect in the subsequent processes, including extrusion, deformation, and aging procedures.

The parameters in the aging treatment used in Comparative Example 4 are different from those in Example 1, and the obtained magnesium alloy profile exhibits a great reduction in comprehensive mechanical properties in the aged state. This is because the precipitated phase during aging at 280° C. has larger particles which have a poor dispersion strengthening effect, and a large amount of solid solution elements are consumed by the precipitation of the incoherent β phase, which greatly weakens the strengthening effect in the subsequent aging at 220° C.

In Example 5, the ingot blank, the extrusion die, and the extrusion container are preheated to a temperature that is optimized compared to that in Example 1. As a result, it is found that the obtained profile has higher strength and slightly lower plasticity. This is because the reduced extrusion temperature can effectively control the refinement of the extruded microstructure, and also contributes to the formation of a duplex microstructure, which can facilitate a great increase in strength and a slight reduction in plasticity.

Example 6 is carried out at an extrusion rate and an extrusion ratio falling within the preferred ranges of the present disclosure, and the obtained profile has higher strength and slightly lower plasticity than that of Example 1. This is because under the condition where a sufficiently refined microstructure can be ensured even at a slightly lower extrusion ratio, the reduced extrusion rate contributes to a reduction in temperature rise during deformation and reduces the tendency of growth of recrystallized grains.

Although the present disclosure has been illustrated and described with specific examples, it should be appreciated that many other variations and modifications can be made without departing from the spirit and scope of the present disclosure. It is therefore intended to cover in the appended claims all such variations and modifications that are within the scope of the present disclosure.

INDUSTRIAL APPLICABILITY (1) The present disclosure proposes a high-strength magnesium alloy profile, which has high comprehensive mechanical properties at room temperature and high plasticity, a tensile strength greater than 430 MPa, and an elongation greater than 8%. Compared with an aircraft unit load device formed from an aluminum alloy, this profile allows a single unit load device to have its weight reduced by more than 20%.

(2) The high-strength magnesium alloy profiles of the present disclosure are prepared by a simple process and can be produced in batches by ordinary extrusion production equipment, and thus the direct extrusion molding of high-strength magnesium alloy profiles is implemented with higher efficiency.

What is claimed is:

1. A process for preparing a magnesium alloy profile, comprising steps of:

sequentially performing a temperature-varying homogenizing treatment, extruding, straightening and aging treatment on a magnesium alloy ingot, so as to obtain a magnesium alloy profile, wherein the temperature-varying homogenizing treatment comprises steps of increasing a temperature from room temperature to 200 to 300° C. within 30 min and maintaining the temperature for 2 to 4 h; further increasing the temperature to 410 to 480° C. within 40 min and maintaining the temperature for 6 to 15 h; further increasing the temperature to 520 to 530° C. within 30 min and then maintaining the temperature for 8 to 10 h; subsequently decreasing the temperature to 300 to 460° C. and maintaining the temperature for 4 to 8 h, wherein the magnesium alloy ingot comprises following components in mass percentage: 6 to 12% of Gd, 2.5 to 8.5% of Y, 0.2 to 2% of Zn, 0.2 to 2% of Mn, and Mg and inevitable impurities as a remainder; and the aging treatment comprises one of isothermal aging treatment, two-stage aging treatment, and temperature-varying aging treatment, wherein the isothermal aging treatment is performed at a temperature ranging from 150 to 250° C., the two-stage aging treatment is performed at a temperature ranging from 120 to 160° C. and at a temperature ranging from 160 to 250° C., and the temperature-varying aging treatment is performed at a temperature ranging from 400 to 500° C. and at a temperature ranging from 150 to 250° C., wherein a strengthening phase in a magnesium alloy in an extruded state comprises an LPSO phase and a β phase, wherein the LPSO phase is contained in a volume fraction of 1 to 40%, and the β phase is contained in a volume fraction of 1 to 20%; and a strengthening phase in a magnesium alloy in an aged state comprises an LPSO phase, a β phase, a β' phase, and a γ' phase, wherein the LPSO phase is contained in a volume fraction of 1 to 40%, the β phase is contained in a volume fraction of 1 to 20%, the β' phase has a number density of $10^{15}$ to $10^{25}$ $m^{-3}$ and an aspect ratio l/d of 1 to 20, and the γ' phase has a number density of $10^{14}$ to $10^{24}$ $m^{-3}$ and an aspect ratio l/d of 1 to 50.

2. The process for preparing the magnesium alloy profile according to claim 1, wherein in the magnesium alloy in the extruded state, the LPSO phase is contained in a volume fraction of 5 to 30%, and the β phase is contained in a volume fraction of 3 to 15%.

3. The process for preparing the magnesium alloy profile according to claim 2, wherein in the magnesium alloy in the aged state, the LPSO phase is contained in a volume fraction of 5 to 30%, the β phase is contained in a volume fraction of 3 to 15%, the β' phase has a number density of $10^{20}$ to $10^{25}$ $m^{-3}$ and an aspect ratio l/d of 3 to 20, and the γ' phase has a number density of $10^{18}$ to $10^{24}$ $m^{-3}$ and an aspect ratio l/d of 10 to 50.

4. The process for preparing the magnesium alloy profile according to claim 1, wherein when tensile mechanical properties are tested in the extruded state, tensile strength is 300 to 450 MPa, yield strength is 200 to 400 MPa, and elongation is 10 to 30%; and when the tensile mechanical properties are tested in the aged state, the tensile strength is 400 to 580 MPa, the tensile yield strength is 300 to 520 MPa, and the elongation is 5 to 20%.

5. The process for preparing the magnesium alloy profile according to claim 1, wherein the magnesium alloy ingot comprises the following components in mass percentage: 6 to 12% of Gd, 2.5 to 8.5% of Y, 0.2 to 2% of Zn, 1.2 to 1.5% of Mn, and Mg and inevitable impurities as the remainder.

* * * * *